US005431394A

United States Patent [19]

Stewart

[11] Patent Number: 5,431,394

[45] Date of Patent: Jul. 11, 1995

[54] MULTI-DIMENSIONAL BALL-STRIKING PADDLE

[76] Inventor: John M. Stewart, 17 Martin Ave., Blasdell, N.Y. 14219

[21] Appl. No.: 151,560

[22] Filed: Nov. 12, 1993

[51] Int. Cl.[6] ..... A63B 59/00

[52] U.S. Cl. ..... 273/67 R

[58] Field of Search ..... 273/67 R, 67 B, 317, 273/318, 319, 320, 321, 323, 328, 329, 330, 331, 335, 342, 412, 413, 414

[56] References Cited

U.S. PATENT DOCUMENTS 2,938,728 5/1960 Green ..... 273/81 D X
2,987,316 6/1961 Butera ..... 273/67 B
4,047,717 9/1977 Deangeles ..... 273/67 R X
4,627,623 12/1986 Perilli ..... 273/328

FOREIGN PATENT DOCUMENTS 297530 9/1928 United Kingdom ..... 273/328

*Primary Examiner*—William H. Grieb
*Attorney, Agent, or Firm*—Joseph P. Gastel

[57] ABSTRACT

A multi-dimensional ball-striking paddle consisting of a frame, handles on the frame, a primary ball-striking surface affixed to the frame, and a plurality of secondary balls striking surfaces extending transversely to the primary ball-striking surface.

22 Claims, 4 Drawing Sheets

Fig. 4.
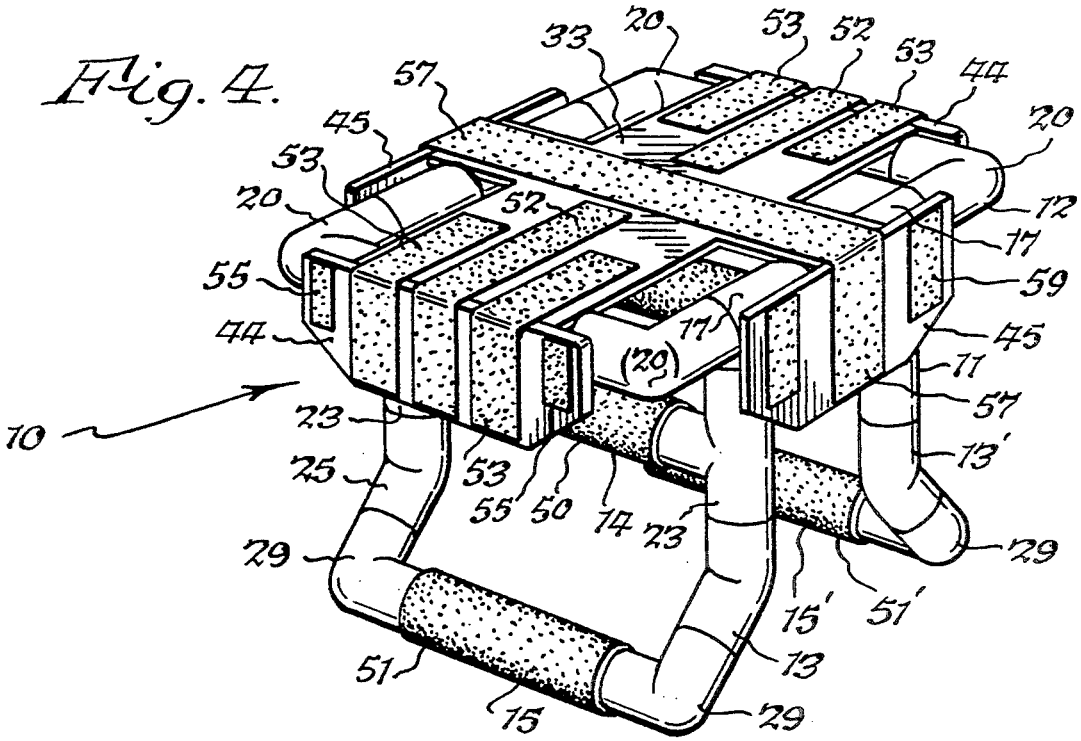
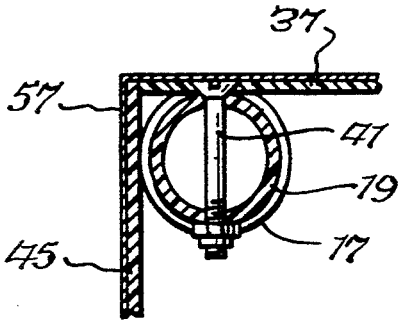
Fig. 5.
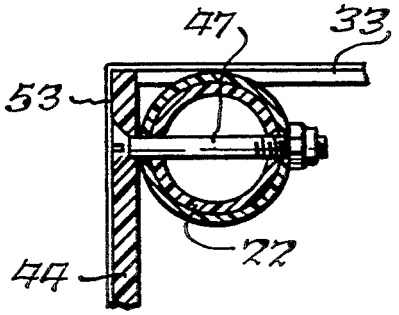
Fig. 6.
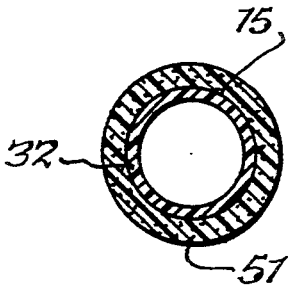
Fig. 7.

MULTI-DIMENSIONAL BALL-STRIKING PADDLE

BACKGROUND OF THE INVENTION

The present invention relates to a multi-dimensional ball-striking paddle for use in striking a ball such as a volleyball.

SUMMARY OF THE INVENTION

It is the object of the present invention to provide a multi-dimensional ball-striking paddle which can be used to strike balls of the type which are used in volleyball or other balls which are too heavy to be struck with a conventional paddle or a racket such as used in tennis.

Another object of the present invention is to provide a multi-dimensional ball-striking paddle which can be gripped in a plurality of different ways in view of the fact that it has four separate handles which can be grasped in different combinations thereof.

A further object of the present invention is to provide a multi-dimensional ball-striking paddle which will permit the user to exercise different sets of muscles depending on the manner in which the paddle is grasped.

Yet another object of the present invention is to provide a multi-dimensional ball-striking paddle wherein the ball-striking surfaces are located in different positions so that it causes the user to exercise extreme coordination for causing the ball-striking surfaces to hit the ball squarely. Other objects and attendant advantages of the present invention will readily be perceived hereafter.

The present invention relates to a multi-dimensional ball-striking paddle comprising a primary ball-striking surface, a plurality of secondary ball-striking surfaces extending transversely to said primary ball-striking surface, and means connected relative to said primary and secondary ball-striking surfaces for being gripped by a user.

The various aspects of the present invention will be more fully understood when the following portions of the specification are read in conjunction with the accompanying drawings wherein:

BRIEF DESCRIPTION OF THE DRAWINGS

FIG. 4 is a perspective view of the paddle;

FIG. 5 is a fragmentary cross sectional view taken substantially along line 5—5 of FIG. 1;

FIG. 6 is a fragmentary cross sectional view taken substantially along line 6—6 of FIG. 2;

FIG. 7 is a cross sectional view taken substantially along line 7—7 of FIG. 3;

DESCRIPTION OF THE PREFERRED EMBODIMENTS

Figure 1:
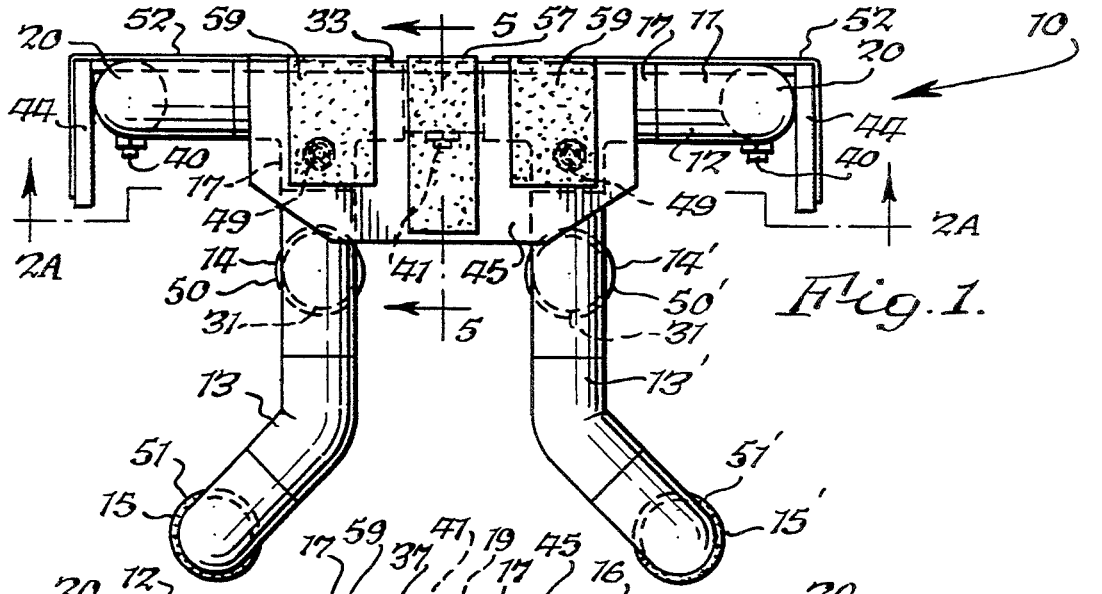
FIG. 1 is a side elevational view of the multi-dimensional ball-striking paddle of the present invention.

The multi-dimensional ball-striking paddle 10 of the present invention includes a frame 11 consisting of a table portion 12 and legs 13 and 13', which are mirror images of each other. A primary handle 14 and a secondary handle 15 are mounted on leg 13, and a primary handle 14' and a secondary handle 15' are mounted on leg 13'.

The frame 11, as shown, is constructed in the following manner. The table portion 12 is fabricated of PVC tubular pipe fitting parts of various configurations. In this respect, sides 16 each comprise two Ts 17 (FIG. 2A) which are mounted on long nipples 19. Ts 17 mount elbows 20 at their opposite ends by means of nipples 19*a*. Sides 21 (FIG. 2C) comprise elongated nipples 22 which enter elbows 20. The joints of the various tubes are suitably secured by PVC adhesive.

Figure 3:
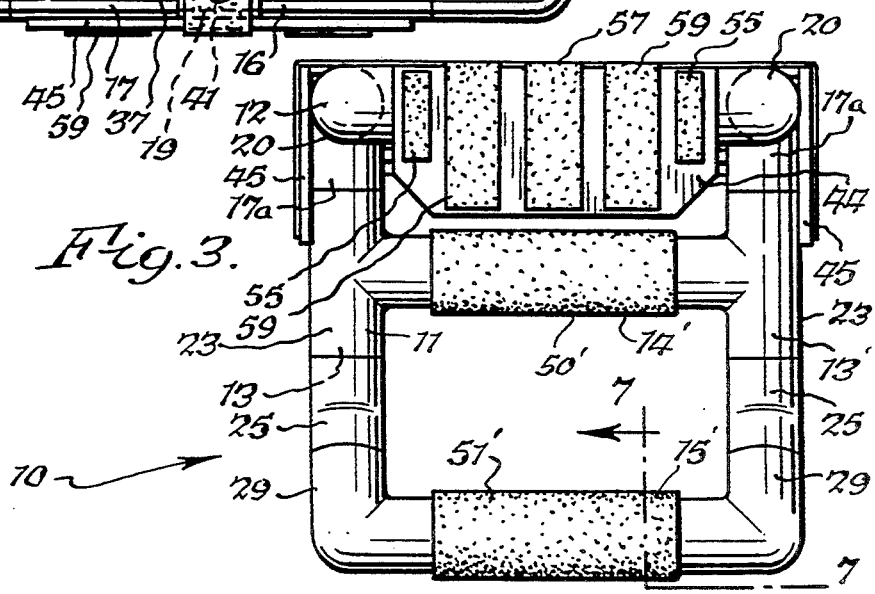
FIG. 3 is an end elevational view of the paddle.

The legs 13 and 13', as noted above, are mirror images of each other. Leg 13 will be described in detail with unprimed numerals and the corresponding parts of leg 13' will be designated by corresponding primed numerals. The leg 13 at its upper portion comprises legs 17*a* of Ts 17. Ts 23 (FIG. 3) are connected to lower legs 17*a* by means of nipples 24 (FIG. 2B). Two 135° elbows 25 are connected to the lower ends of Ts 23 by nipples 27. Elbows 29 are connected to 135° elbows 25 by nipples 30. Corresponding connections of leg 13' are denoted by primed numerals which correspond to the unprimed numerals of leg 13. The structure of leg 13 is shown in FIG. 2C wherein the parts on opposite sides of leg 13 are designated by the same numerals notwithstanding that they are mirror image counter-parts. Ts 23 are connected to each other by a nipple 31 and T 29 are connected to each other by a nipple 32. Leg 13' has analogous structure.

Figure 2:
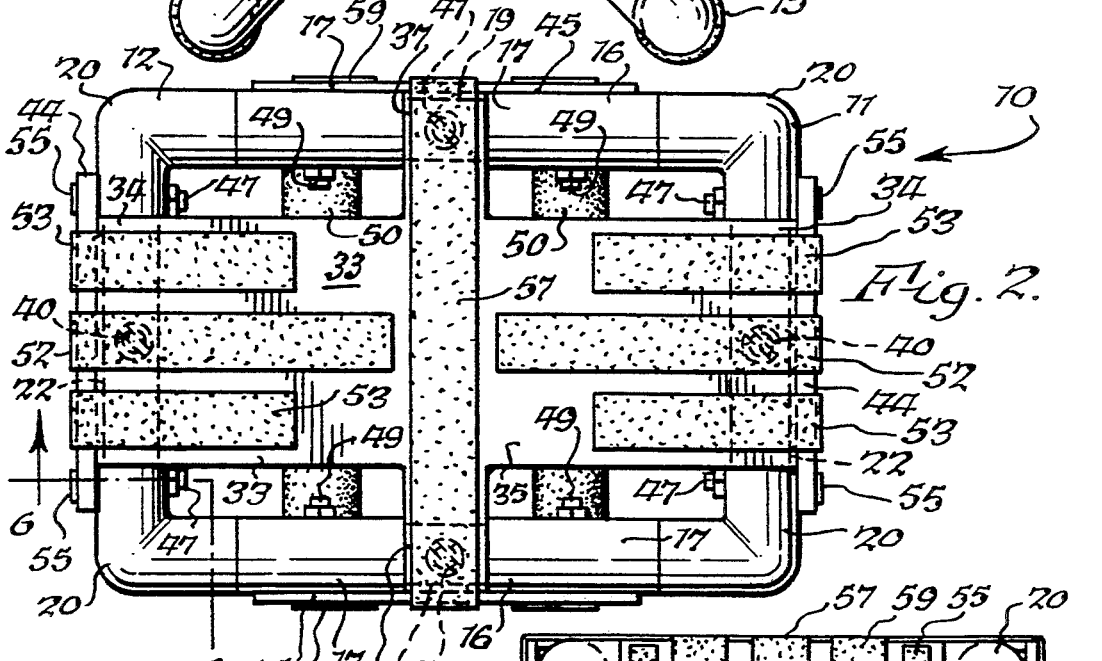
FIG. 2 is a top plan view of the paddle.
Figure 2A:
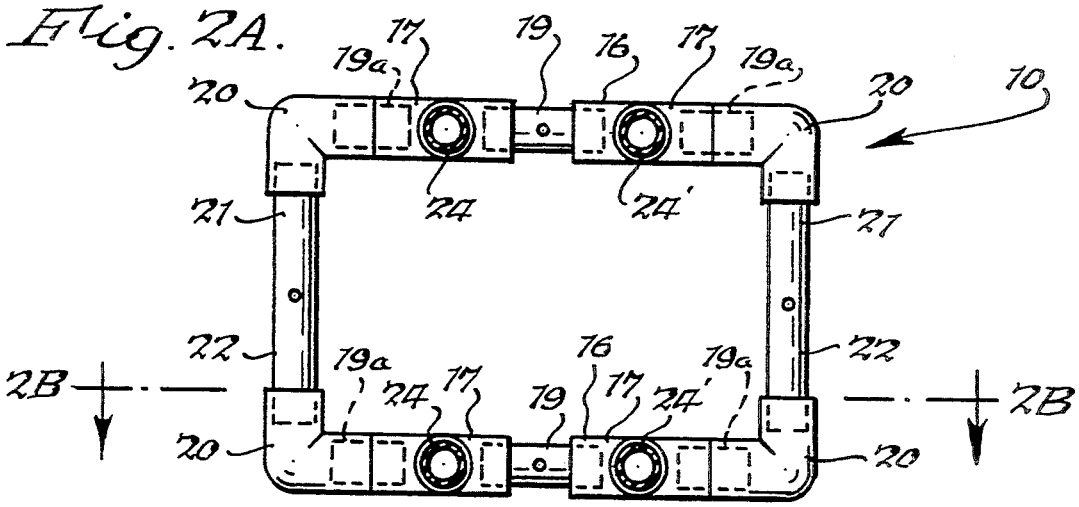
FIG. 2A is a reduced cross sectional view of the paddle taken substantially along line 2A—2A of FIG. 1 with certain parts omitted.
Figure 2B:
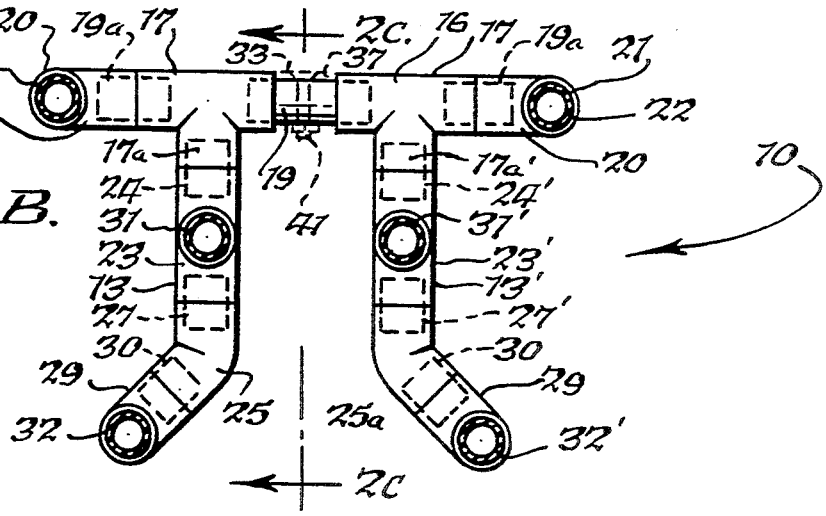
FIG. 2B is a cross sectional view taken substantially along line 2B—2B of FIG. 2A.
Figure 2C:
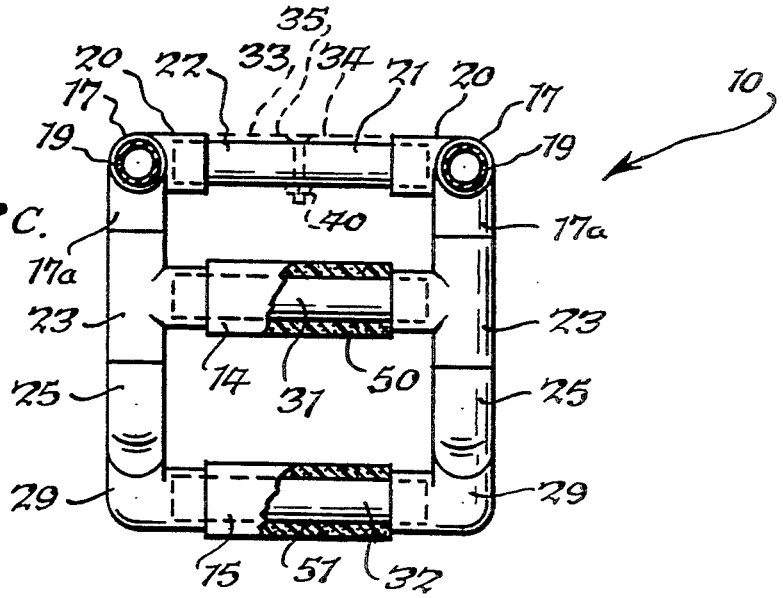
FIG. 2C is a fragmentary cross sectional view taken substantially along line 2C—2C of FIG. 2B.

A primary striking surface 33 (FIG. 4) is fabricated of sheet plastic and it includes a rectangular surface having ends 34 which fit onto nipples 22 (FIG. 2). As can be seen from FIG. 2C, the top surface 35 is flush with the tops of elbows 20. Primary striking surface 33 also has side tabs 37 which rest on the central portions of nipples 19 (FIGS. 2 and 5). The sides 39 of tabs 37 are located in contiguous relationship to the ends of Ts 16, and the upper surfaces of tabs 37 are flush with the uppermost portions of T 17 adjacent thereto. The ends of primary striking surface 33 are secured to nipples 22 by bolts 40, and tabs 37 are secured to nipples 19 by bolts 41. The primary surface 33 has a small amount of resilience to it which yields when striking a ball. It is to be again noted that the top surface of striking surface 33 and the uppermost surfaces of the top of the frame consisting of T 17 and elbows 20 are all in substantially the same plane.

A plurality of secondary striking surfaces 44 and 45 are affixed to the top of frame 11. More specifically, secondary striking surfaces 44 are affixed to the ends of the table 12 of frame 11 and secondary striking surfaces 45 are affixed to the sides of table 12. All of the striking surfaces are plastic plate-like members and are of the shapes shown in the drawings. Striking surfaces 44 are affixed by bolts 47 (FIG. 6) at each end thereof to elbows 20. Striking surfaces 45 are affixed at each end thereof to Ts 17 by bolts 49. The sections of FIGS. 5 and 6 are typical of the bolting means used for the tabs 34 and 37 and the striking surfaces 44 and 45.

Nipples 31 and 31' (FIGS. 1 and 2C) constitute the cores of primary handles 14 and 14', respectively, and nipples 32 and 32' constitute the cores of secondary handles 15 and 15', respectively. The outer surfaces of handles 14 and 14' are covered by elastomeric foam grips 50 and 50', respectively. The cores 32 and 32' of secondary handles 15 and 15', respectively, are covered by elastomeric foam grips 51 and 51', respectively.

Roughened rubber strips 52 and 53 are located as shown on primary striking surface 33 and they extend over onto secondary striking surfaces 44. Roughened rubber strips 55 are also located on striking surfaces 44. A roughened rubber strip 57 extends crosswise across primary striking surface 33 and along tabs 37 and onto secondary striking surfaces 45. Also roughened rubber strips 59 are cemented to striking surfaces 45.

Figure 8:
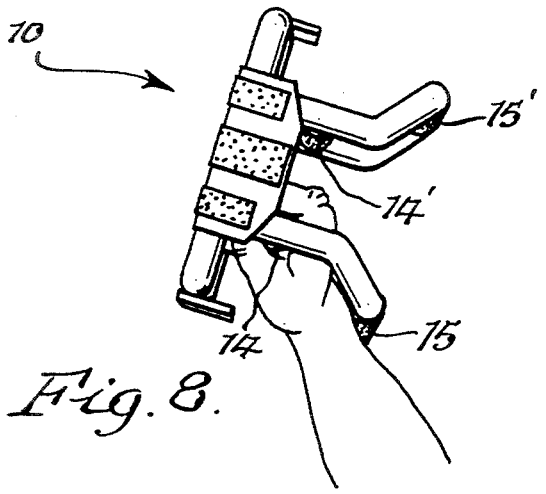
FIG. 8 is a perspective view showing one way in which the paddle can be gripped.
Figure 11:
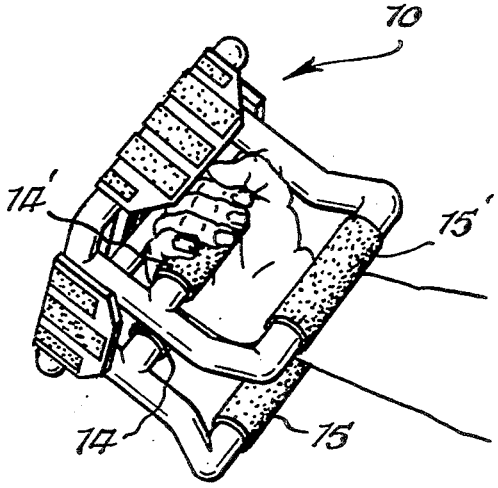
FIG. 11 is a perspective view showing another way in which the paddle can be gripped.
Figure 9:
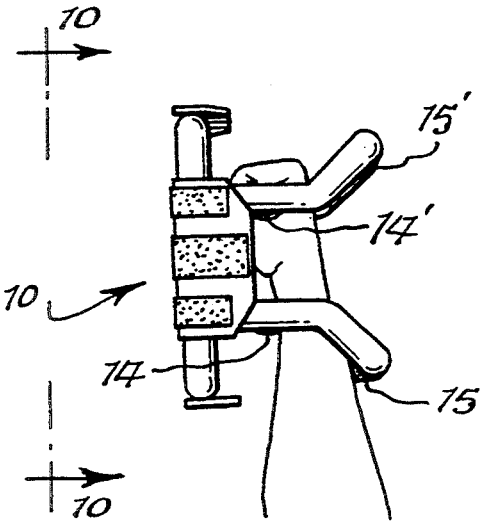
FIG. 9 is a side elevational view showing another way in which the paddle can be gripped.
Figure 12:
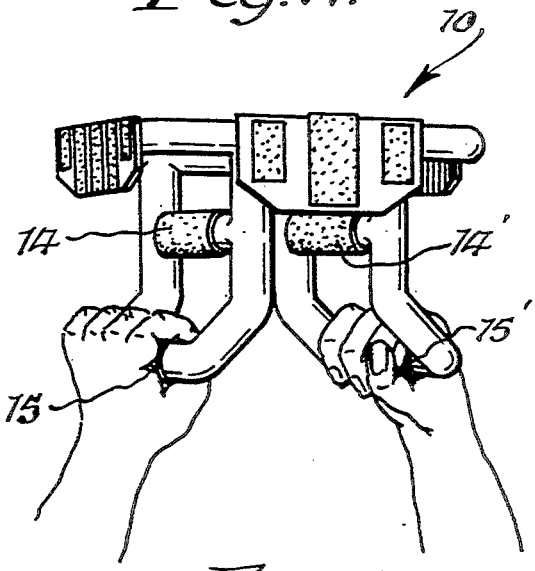
FIG. 12 is a perspective view of a two-handed grip for the paddle.
Figure 10:
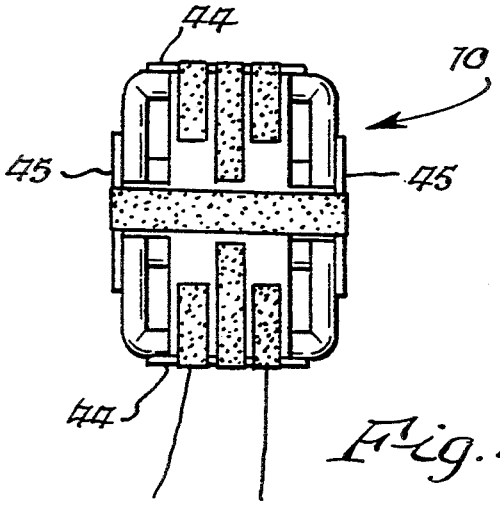
FIG. 10 is a view taken substantially in the direction of arrows 10—10 of FIG. 9.

In use the multi-dimensional ball-striking paddle 10 of the present invention can be held in any number of ways as pictorially depicted in FIGS. 8–12, and as described hereafter. In FIG. 8 a grip is shown wherein the primary handle 14 is grasped and the secondary handle 15 rests against the back of the wrist of the user. In FIG. 9 a grip is shown wherein the user grips handle 14' and rests the back of his arm against grip 15 with the forearm being located between grips 14' and 15. In FIG. 11 a grip is shown wherein the user grips handle 14 and rests the front of his wrist against grip 15'. In FIG. 12 a grip is shown wherein the user grasps secondary handles 15 and 15'. Not shown is a grip such as FIG. 12 wherein the user grasps both primary handles 14 and 14' with his forearms between grips 15 and 15' or with his forearms on the outsides of secondary grips 15 and 15'. When the forearms are between legs 13 and 13', the back of the wrists can bear against grips 15 and 15'. When the forearms are on the outsides of legs 13 and 13' when primary grips 14 and 14' are being grasped, grips 15 and 15' will bear against the insides of the user's wrists.

The multi-dimensional paddle thus permits volleyball or the like to be played as a racket sport whereas this cannot be done with prior rackets of the type used in tennis because the ball is too heavy. It will also be appreciated that with the various grips, the ball can be struck with either the primary striking surfaces or any one of the secondary striking surfaces. Furthermore, when the secondary striking surfaces are used, the user must have good coordination so as to cause the ball to be struck by the flat of the secondary surfaces in order to provide good control.

While the specific construction of the multi-dimensional ball-striking paddle was based on a model which was fabricated, it will be appreciated that commercially various parts of the paddle can be cast in one piece and possibly certain of the ball-striking surfaces can also be cast along with the frame.

While preferred embodiments of the present invention have been disclosed, it will be appreciated that it is not limited thereto but may be otherwise embodied within the scope of the following claims.

What is claimed is:

1. A multi-dimensional ball-striking paddle comprising a primary ball-striking surface, a plurality of secondary ball-striking surfaces extending transversely to said primary ball-striking surface in non-planar relationship thereto, and a plurality of handles connected relative to said primary and secondary ball-striking surfaces for being gripped by a user.

2. A multi-dimensional ball-striking paddle as set forth in claim 1 wherein said plurality of handles comprise at least two handles which are spaced from each other and extend substantially parallel to said primary ball-striking surface.

3. A multi-dimensional ball-striking paddle as set forth in claim 1 wherein said plurality of handles comprise at least two handles which extend substantially parallel to said primary ball-striking surface and are spaced different distances therefrom.

4. A multi-dimensional ball-striking paddle as set forth in claim 1 wherein said plurality of handles comprise at least two handles which extend transversely to at least one of said secondary ball-striking surfaces.

5. A multi-dimensional ball-striking paddle as set forth in claim 4 wherein said at least two handles are spaced different distances from said primary ball-striking surface.

6. A multi-dimensional ball-striking paddle as set forth in claim 5 wherein said at least two handles are substantially parallel to said primary ball-striking surface.

7. A multi-dimensional ball-striking paddle as set forth in claim 1 including roughened rubber strips on said primary and secondary ball-striking surfaces.

8. A multi-dimensional ball-striking paddle comprising a primary ball-striking surface, a plurality of secondary ball-striking surfaces extending transversely to said primary ball-striking surface, means connected relative to said primary and secondary ball-striking surfaces for being gripped by a user, said means connected relative to said primary and secondary ball-striking surfaces comprising frame means mounting said primary and secondary ball-striking surfaces, handle means connected to said frame means for being gripped by a user, said primary ball-striking surface comprising a first substantially planar surface, said secondary ball-striking surfaces comprising second substantially planar surfaces which are smaller than said primary ball-striking surface, said secondary ball-striking surfaces extending substantially perpendicularly to said primary ball-striking surface, said handle means including primary handle means located a first distance from said primary ball-striking surface, and secondary handle means located a second distance from said primary ball-striking surface which is greater than said first distance.

9. A multi-dimensional ball-striking paddle as set forth in claim 8 wherein said primary and secondary handle means extend substantially parallel to said primary ball-striking surface.

10. A multi-dimensional ball-striking paddle as set forth in claim 8 wherein said primary handle means comprise two first spaced handles, and wherein said secondary handle means comprise two second spaced handles.

11. A multi-dimensional ball-striking paddle as set forth in claim 10 wherein said two first spaced handles are closer to each other than said two second spaced handles.

12. A multi-dimensional ball-striking paddle as set forth in claim 11 wherein said two first spaced handles are substantially parallel to each other, and wherein said two second spaced handles are substantially parallel to each other.

13. A multi-dimensional ball-striking paddle as set forth in claim 12 wherein said first and second spaced handles are mounted on legs connected to said frame means.

14. A multi-dimensional ball-striking paddle as set forth in claim 13 wherein said legs include portions which diverge outwardly from each other.

15. A multi-dimensional ball-striking paddle as set forth in claim 14 wherein said second handles are mounted on said portions of said legs which diverge outwardly from each other.

16. A multi-dimensional ball-striking paddle as set forth in claim 15 including elastomeric covers on said handles.

17. A multi-dimensional ball-striking paddle comprising a primary ball-striking surface, a plurality of secondary ball-striking surfaces extending transversely to said primary ball-striking surface, means connected relative to said primary and secondary ball-striking surfaces for being gripped by a user, said primary ball-striking surface comprising a first plate-like member, said secondary ball-striking surfaces comprising second plate-like members which are smaller than said first plate-like member, said second plate-like members extending substantially perpendicularly to said first plate-like member, said first plate-like member being of substantially rectangular shape having four sides, and said second plate-like members comprising four members which are located substantially along said four sides of said first plate-like member.

18. A multi-dimensional ball-striking paddle as set forth in claim 17 wherein said means connected relative to said primary and secondary ball-striking surfaces comprise frame means mounting said first and second plate-like members, and handle means connected to said frame means for being gripped by a user.

19. A multi-dimensional ball-striking paddle as set forth in claim 18 wherein said handle means comprise first and second spaced legs connected to said frame means, and a first handle mounted on each of said first and second spaced legs, and a second handle mounted on each of said first and second spaced legs.

20. A multi-dimensional ball-striking paddle as set forth in claim 19 wherein said first handles are closer to each other than said second handles, and wherein said first handles are closer to said first plate than said second handles.

21. A multi-dimensional ball-striking paddle comprising a primary ball-striking surface, a plurality of secondary ball-striking surfaces extending transversely to said primary ball-striking surface, handle means connected relative to said primary and secondary ball-striking surfaces for being gripped by a user, said handle means including primary handle means located a first distance from said primary ball-striking surface, and secondary handle means located a second distance from said primary ball-striking surface which is greater than said first distance.

22. A multi-dimensional ball-striking paddle comprising a primary ball-striking surface, a plurality of secondary ball-striking surfaces extending transversely to said primary ball-striking surface in non-planar relationship thereto, means connected relative to said primary and secondary ball-striking surfaces for being gripped by a user, said means connected relative to said primary and secondary ball-striking surfaces comprising frame means mounting said primary and secondary ball-striking surfaces, and handle means connected to said frame means for being gripped by a user, said primary ball-striking surface comprising a first substantially planar surface, and said secondary ball-striking surfaces comprising second substantially planar surfaces which are smaller than said primary ball-striking surface, said secondary ball-striking surfaces extending substantially perpendicularly to said primary ball-striking surface, and said handle means comprising a plurality of handles.

* * * * *